US005196987A

United States Patent [19]

Webber et al.

[11] Patent Number: 5,196,987

[45] Date of Patent: Mar. 23, 1993

[54] ELECTRIC BUSWAY POWER TAKE-OFF ASSEMBLY

[75] Inventors: Timothy W. Webber, Bristol; Louis A. Rosen, Hartford; Louis M. Frutuoso, Newington, all of Conn.

[73] Assignee: General Electric Company, New York, N.Y.

[21] Appl. No.: 858,471

[22] Filed: Mar. 27, 1992

[51] Int. Cl.[5] ..... H01R 25/16

[52] U.S. Cl. ..... 361/334; 361/353; 361/355; 439/212; 439/856

[58] Field of Search ..... 439/212, 114, 856, 857, 439/861, 862; 200/297; 361/353, 355, 334

[56] References Cited

U.S. PATENT DOCUMENTS

| | | | |
|---|---|---|---|
| 3,087,039 | 4/1963 | Bachman | 439/212 |
| 4,758,172 | 7/1988 | Richards et al. | 439/212 |
| 4,804,804 | 2/1989 | Hibbert et al. | 174/16.2 |
| 4,886,468 | 12/1989 | Harton et al. | 439/212 |
| 4,957,447 | 9/1990 | Hibbert et al. | 439/207 |

FOREIGN PATENT DOCUMENTS

| | | | |
|---|---|---|---|
| 678095 | 1/1964 | Canada | 439/212 |
| 856957 | 11/1970 | Canada | 439/212 |
| 2006562 | 8/1970 | Fed. Rep. of Germany | 439/212 |
| 916765 | 1/1963 | United Kingdom | 439/212 |

*Primary Examiner*—Gary F. Paumen
*Attorney, Agent, or Firm*—Richard A. Menelly

[57] ABSTRACT

A power take-off assembly utilized in electric power distribution systems includes stabs, multi-surface conductor connectors, conductive straps, and a circuit breaker. The multi-surface connection conductors and straps each consist of a single copper or aluminum piece that facilitates electrical connection between the circuit breaker disposed within the power take-off assembly and the receiver stabs. The receiver stabs protrude from the power take-off assembly and engage with the power source thereby providing electric power to the circuit breaker.

5 Claims, 4 Drawing Sheets

ELECTRIC BUSWAY POWER TAKE-OFF ASSEMBLY

BACKGROUND OF THE INVENTION

Electrical power distribution systems, as frequently utilized in industry, include a busway and a power take-off assembly. As described in U.S. Pat. No. 4,804,804, the busway system consists of a housing and a plurality of generally rectangular copper or aluminum conductor busbars disposed therein.

Each busbar includes spaced tabs that protrude through the busway housing for connection with a power take-off assembly, as described in U.S. Pat. Nos. 4,758,172 and 4,886,468. A power take-off assembly generally consists of a box-like metallic or plastic enclosure containing various electrical accessories. Spring type contact blade receiver stabs protrude from the rear wall of the power take-off assembly and engage the busbar tabs. The power take-off assembly is fastened onto the busway by means of hook fasteners whereby the receiver stabs make electrical and physical contact with the tabs of the busbars. Typically, each busbar carries a separate phase of a multi-phase power distribution system with a corresponding number of receiver stabs engaging each separate busbar.

Each stab includes jaw-like clips having spring motion in one portion and flanges in the other. The jaw-like portion of the stabs protrudes through the power take-off assembly housing to attach to the busway tabs. The receiver stab flanges are typically pressed into multiple copper bars that are bolted together for electrical connection.

The copper bars are attached to a perpendicularly situated plurality of similar copper bars, comprising a "strap", which strap is in turn attached to a corresponding phase of a circuit breaker, thereby supplying electrical power from the busbars to the circuit breaker.

State-of-the-art connections containing multiple copper or aluminum bars between the stabs and the circuit breaker are labor intensive due to the multitude of bars which must be fastened together. Such take-off connections require a large amount of space and are not generally cost efficient. Since the take-offs are not thermally efficient, additional heat sinks are often required.

One purpose of the instant invention is to provide a take-off assembly that provides connection between the stabs and the circuit breaker with improved thermal and space efficiency and at a lower cost.

SUMMARY OF THE INVENTION

The invention comprises a single piece multi-surface connection conductor and a single piece strap, connected together to form a power take-off assembly providing connection between a stab and a circuit breaker. Each stab is engaged with corresponding busbar tabs supplying electrical power to an electrical power distribution system. The multi-surface connection conductor consists of a single body including a plurality of fingers which engage the stab to thereby establish a multi-surface connection.

DESCRIPTION OF THE PREFERRED EMBODIMENT

Figure 1:
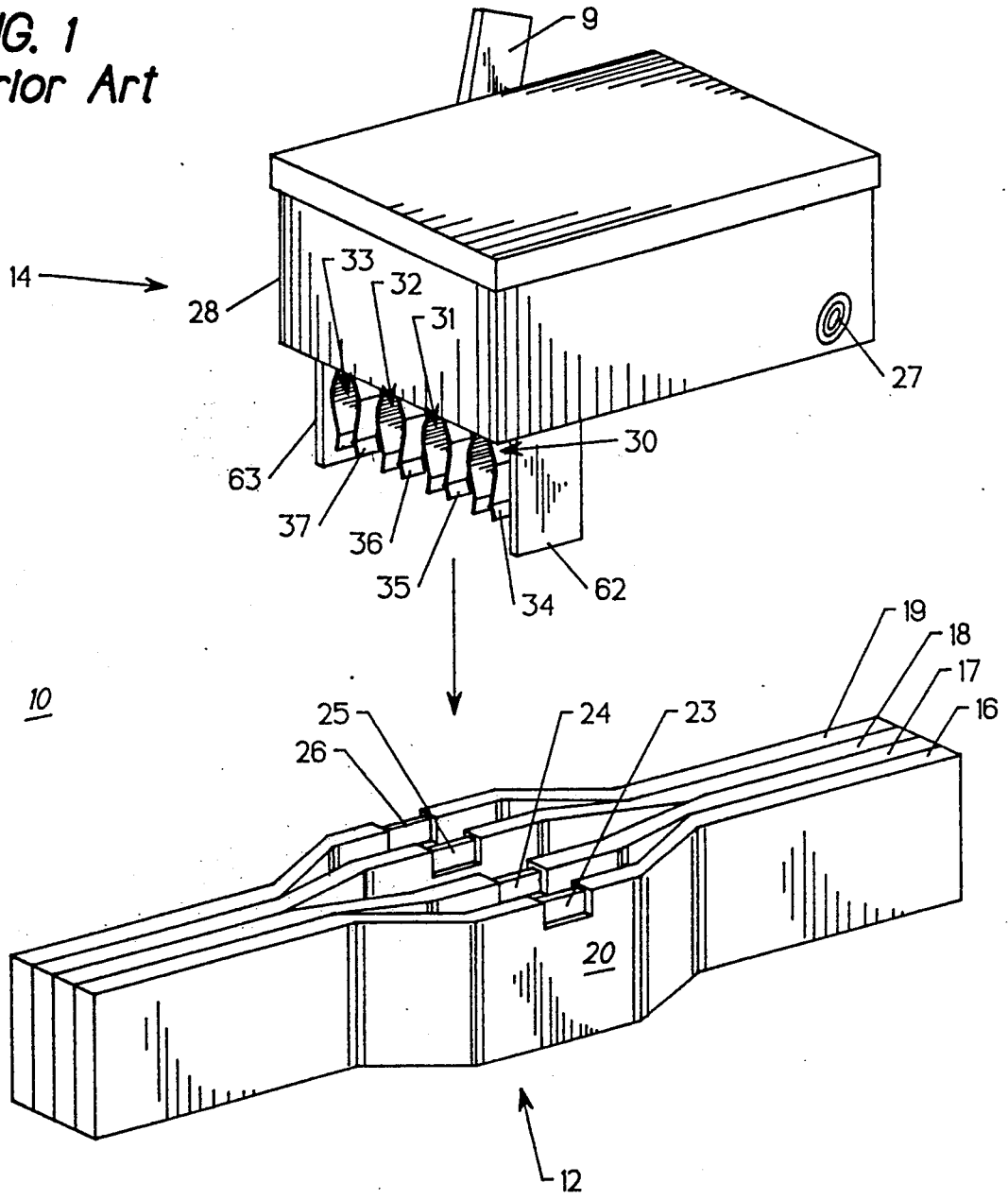
FIG. 1 Prior Art
FIG. 1 is a bottom perspective view of a multi-phase busway system and power take-off assembly according to the prior art.

An industrial power distribution system 10 shown in FIG. 1 and includes a busway system 12 and a busplug or power take-off assembly 14. The busway system 12 as described within aforementioned U.S. Pat. No. 4,886,468 includes a plurality of copper or aluminum busbar conductors 16–19, each carrying a separate phase of a multi-phase power distribution system and each containing an insulating coating 20 to electrically insulate the bars from each other and from the housing. Each busbar also includes an area wherein the insulating coating 20 is removed to expose the copper or aluminum contact tabs 23–26, to accommodate the power take-off assembly 14 for delivering power to associated electrical equipment through a knock-out 27 formed within one side of the enclosure 28 to allow for wire connection between the contact blade receiver stabs 30–33 and the associated electrical equipment. As described within U.S. Pat. No. 4,957,447, the take-off assembly also includes a circuit breaker or disconnect switch that is externally accessed by means of handle 9.

Figure 2:
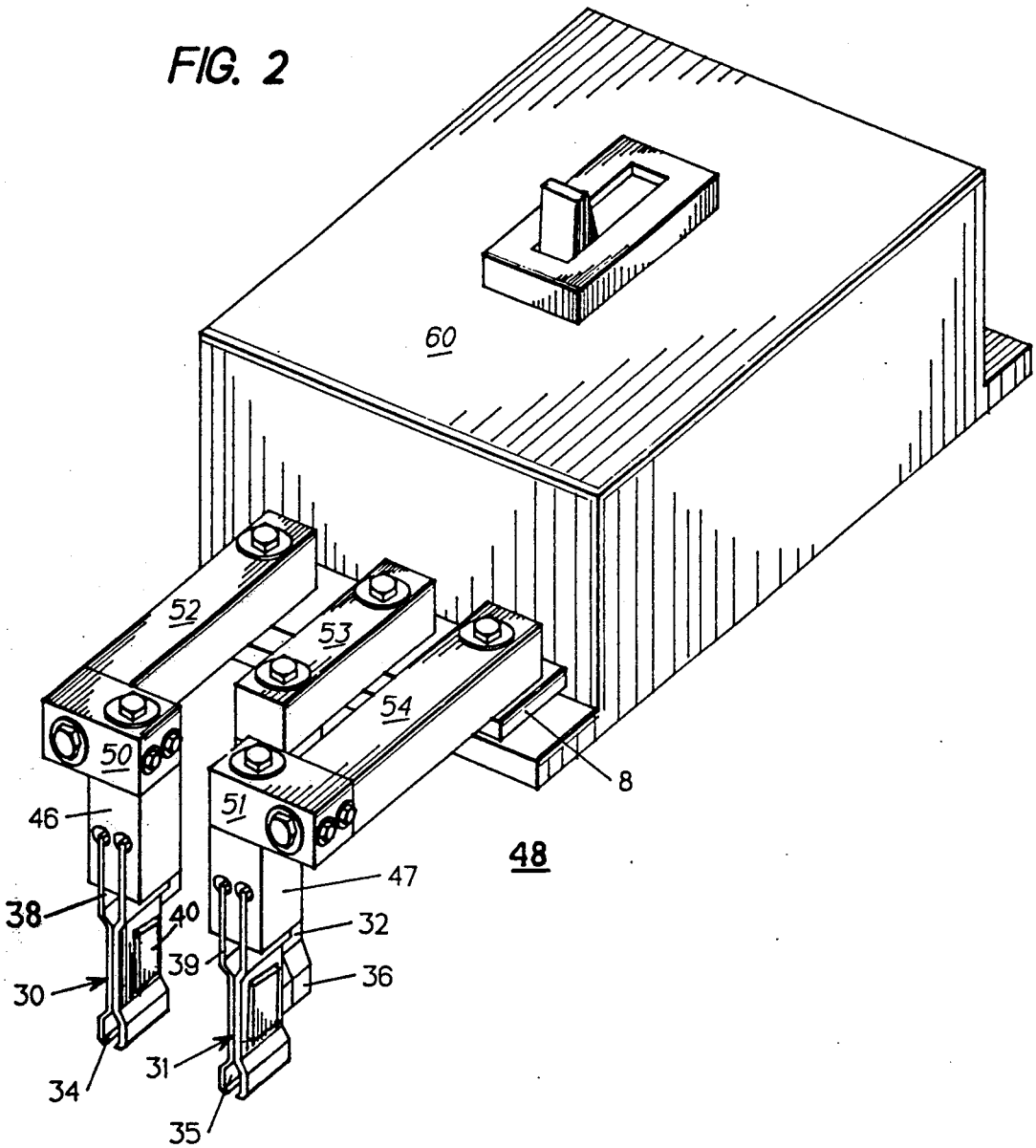
FIG. 2 is a top perspective view of a power take-off assembly according to the invention connected with a molded case circuit breaker.
Figure 3:
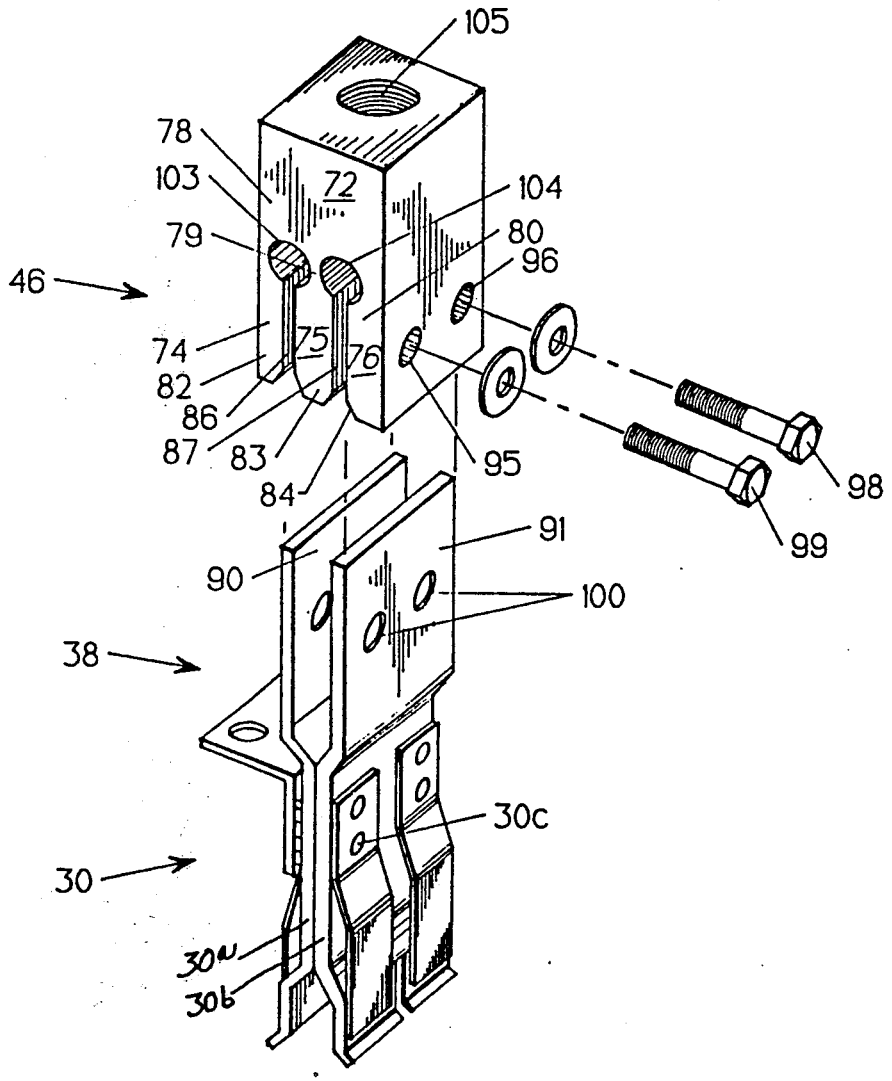
FIG. 3 is an exploded front perspective view of the power take-off assembly of FIG. 2.

The power take-off assembly 14 generally comprises a metallic enclosure 28 with spring-type contact blade receiver stabs 30–33 protruding from a rear wall 35. Each contact blade receiver stab 30–33, as shown in FIGS. 1–3, includes a jaw-like clip portion 34–37 protruding from the power take-off assembly and a flange portion 38, 39 disposed within the enclosure of the power take-off assembly. Each contact blade receiver stab 30 is formed from a pair of bevelled pieces 30A, 30B that are riveted together as indicated at 30C. The bevelled pieces are "mirror images" of each other to allow use of a single design rather than separately formed pieces. In accordance with the teachings of the invention, the power take-off assembly as shown in FIG. 2 also includes multi-surfaced connection blocks or conductors 46, 47 each attached to the corresponding flange portion 38, 39 of the stabs 30–32 on one end and the straps 50, 51 attached to phase straps 53–55 on the other end. The phase straps are then in turn connected to a circuit breaker 60 that is arranged within the take-off assembly enclosure 28 in FIG. 1.

In operation, the power take-off assembly is secured onto the busway by means of locking blades 62, 63 wherein the jaw-like clip portions 34–37 of the receiver stabs 30–33 clamp onto the tabs 23–26 of the busway, as shown in FIG. 1. The power supplied by the busbars is conducted through the stabs 30–32 and connectors 46, 47 and the straps 50–54 to the line straps 8 extending from the circuit breaker 60, as shown in FIG. 2.

As best seen by referring to FIG. 3, each multi-surface connection conductor 46 comprises a single copper or aluminum body 72 which includes a plurality of contact fingers 74–76. Each finger has a root portion 78–80 and an end portion 82–84. The slots 86, 87 between the fingers receive corresponding flanges 90, 91 of the flange portion 38 of the stab 30 pressed therein.

Each surface of the flanges 90, 91 makes a surface contact with the multi-surface connection conductor 46 thereby optimizing heat conduction between the flange portion 38 and the multi-surface connection conductor 46. To further promote good electrical and thermal connection between the clips and the busway, offset plates as generally indicated at 40 are riveted to both pieces 30A, 30B to force the clips into contact with the busway tabs. The offset plates are fabricated from a high carbon steel to ensure spring-like contact between the offset plates and the clips.

The end surfaces of the innermost finger 75 and outermost fingers 74, 76 are tapered to facilitate insertion of the flanges 90, 91.

Thru-holes 95, 96 are formed through the multi-surface connection conductor 46 and fingers 76, 75 and the thru-holes are tapped at one end. Once the multi-surface connection conductor 38 is pressed onto the stab 46, the resultant take-off assembly is attached together by means of screws 98, 99 inserted through the untapped portion of the thru-holes on the multi-surface connection conductor 46 and corresponding oblong shaped holes 100 disposed on the flanges 90, 91 of the stab 30. The screws extend into the tapped ends of the thru-holes to thereby fasten the multi-surface connection conductor onto the stab.

Strain relief radii 103, 104 disposed internally of the root portion 78–80 of the fingers 74–76 compensate for tolerances within the multiple contact surfaces and allows flexibility to the fingers to allow the fingers to better contact the flange surfaces once the screws are fastened. The threaded hole 105 at the top surface of the body 72 opposite the fingers facilitates attachment between the body 72 and the straps 50, 51, as shown in FIG. 2.

Figure 4:
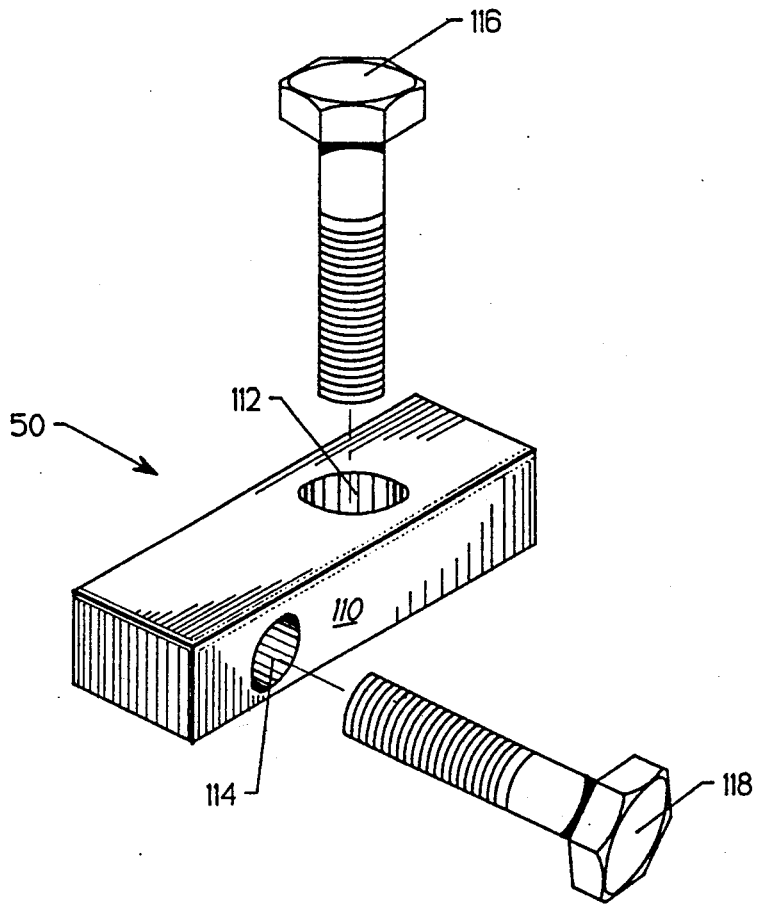
FIG. 4 is an exploded top perspective view of the strap of FIG. 2.

The strap 50, as shown in FIG. 4, includes a generally rectangular aluminum or copper body 110 with two mounting thru-holes 112, 114 formed therein. The mounting holes allow one side of the strap to be fastened to the multi-surface connection conductor 46 and the other side of the strap to be fastened to a phase strap 53 (FIG. 2) by means of screws 116, 118, respectively. The location of the thru-holes 112, 114 can be positioned in accordance with the particular geometry of the components contained within the power take-off assembly.

Figure 5:
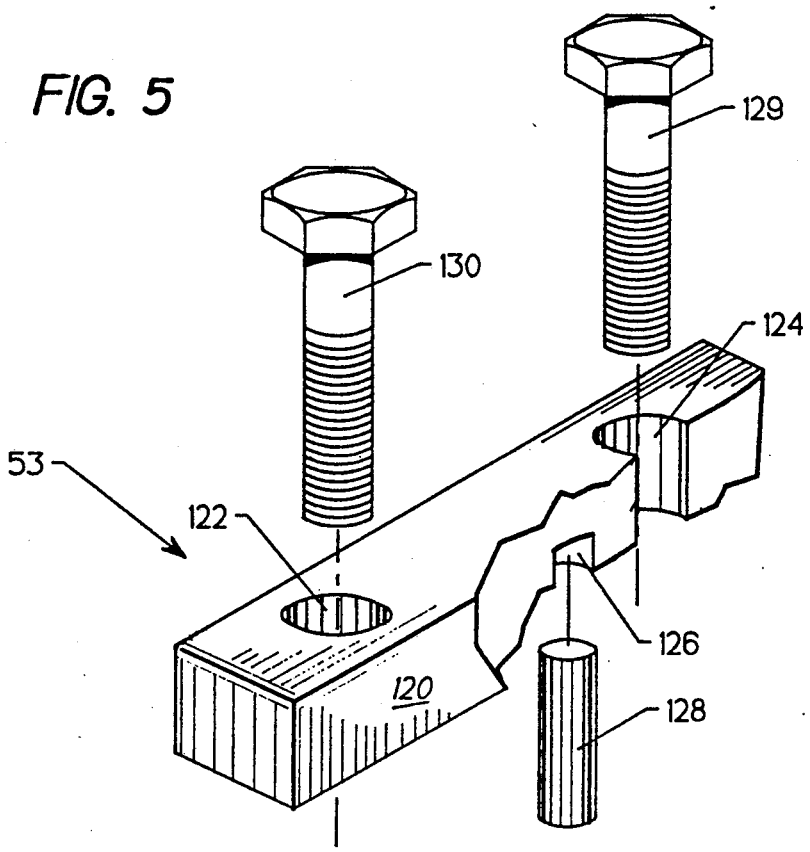
FIG. 5 is an exploded top perspective view of the phase strap of FIG. 2 in partial section.

The phase strap 53, shown in FIG. 5, includes a single generally rectangular aluminum or copper body 120 with a pair of circuit breaker mounting holes 122, 124 and an anti-turn hole 126 disposed therein. The anti-turn hole is located on a bottom surface, in parallel with one of the circuit breaker mounting holes. One end of an anti-turn dowel pin 128 is press fit into the anti-turn hole 126 and the other end of the anti-turn dowel pin is secured within the circuit breaker line strap 8 (FIG. 2) to prevent the power take-off assembly from pivoting. The circuit breaker mounting holes allow the phase strap be fastened onto the circuit breaker line strap by means of a screw 130. The circuit breaker mounting holes also allow a screw 129 to facilitate fastening of one phase strap onto either another phase strap or directly onto the multi-surface connection conductor.

Having thus described our invention, what we claim and desire to secure by Letters Patent is:

1. An electric busway power take-off assembly comprising in combination:

an enclosure;

an electric switch or circuit breaker within said enclosure;

a busway tab connector including a plurality of exterior clips extending from a bottom of said enclosure arranged for engaging corresponding tabs on electric power busway conductors and a plurality of connection conductor blocks arranged within said enclosure and electrically connected with said electric switch or circuit breaker, each of said clips comprising a pair of opposing bevelled pieces of conductive metal fastened together defining a busway tab receiving slot at one end and offset flanges at an opposite end, each of said connection conductor blocks including a plurality of linear slots formed at a bottom thereof receiving said offset flanges in press-fit relation to ensure electric conductivity between said connection conductor blocks and said clips.

2. The busway power take-off assembly of claim 1 wherein said clips are bolted to said connection conductor block.

3. The busway power take-off assembly of claim 1 further including a metal plate fastened to each of said bevelled pieces to force said bevelled pieces into contact with said electric power busway tabs.

4. The busway power take-off assembly of claim 1 wherein said busway connection conductor block includes a threaded opening at a top part thereof to facilitate electrical connection between said connection conductor block and a circuit breaker or electric switch terminal.

5. The busway power take-off assembly of claim 1 including an operating handle arranged exterior to said enclosure and connecting internally with said circuit breaker or electric switch for moving said circuit breaker or electric switch between open and closed conditions.

* * * * *